US007390074B2

(12) United States Patent
Matsuba et al.

(10) Patent No.: US 7,390,074 B2
(45) Date of Patent: Jun. 24, 2008

(54) METHODS OF AND APPARATUSES FOR WIPING A LINE HEAD IN AN INK JET RECORDER

(75) Inventors: Hiroyuki Matsuba, Ohnojo (JP); Yoshinobu Ishimoto, Ohnojo (JP); Tetsuya Matsuzaki, Fukuoka (JP); Hideo Izawa, Narashino (JP); Takao Namiki, Narashino (JP)

(73) Assignees: Natsushita Electric Industrial Co., Ltd., Kadoma (JP); Miyakoshi Printing Machinery Co., Ltd., Narashino (JP)

( * ) Notice: Subject to any disclaimer, the term of this patent is extended or adjusted under 35 U.S.C. 154(b) by 134 days.

(21) Appl. No.: 11/115,720

(22) Filed: Apr. 27, 2005

(65) Prior Publication Data

US 2005/0248612 A1 Nov. 10, 2005

(30) Foreign Application Priority Data

May 7, 2004 (JP) ..... 2004-138669
May 7, 2004 (JP) ..... 2004-138707

(51) Int. Cl.
*B41J 2/165* (2006.01)

(52) U.S. Cl. ..... 347/22; 347/33

(58) Field of Classification Search ..... 347/33, 347/20, 22, 32, 34, 36, 40, 42, 44
See application file for complete search history.

(56) References Cited

U.S. PATENT DOCUMENTS

| | | | | |
|---|---|---|---|---|
| 5,589,865 | A * | 12/1996 | Beeson | 347/28 |
| 5,907,335 | A * | 5/1999 | Johnson et al. | 347/28 |
| 6,517,187 | B1 * | 2/2003 | Dietl et al. | 347/33 |
| 6,916,080 | B2 * | 7/2005 | Okamoto | 347/29 |
| 2002/0175970 | A1 * | 11/2002 | Arai et al. | 347/33 |
| 2003/0081047 | A1 * | 5/2003 | Yearout | 347/28 |
| 2003/0197754 | A1 * | 10/2003 | Nakamura | 347/33 |
| 2004/0196327 | A1 * | 10/2004 | Nishioka | 347/30 |
| 2004/0263557 | A1 * | 12/2004 | Premnath et al. | 347/24 |
| 2005/0231548 | A1 * | 10/2005 | Tsukada | 347/33 |

FOREIGN PATENT DOCUMENTS

| | | |
|---|---|---|
| JP | 2000-198210 | 7/2000 |
| JP | 2001-105612 | 4/2001 |

* cited by examiner

*Primary Examiner*—Juanita D Stephens
(74) *Attorney, Agent, or Firm*—Cohen Pontani Lieberman & Pavane LLP

(57) ABSTRACT

A plurality of long narrow rectangular plate like nozzle heads are inclined together in a direction relative to that in which they are disposed side by side in a line in the line head for permitting ink that also gets into gaps between adjacent nozzle heads to be wiped away.

9 Claims, 9 Drawing Sheets

METHODS OF AND APPARATUSES FOR WIPING A LINE HEAD IN AN INK JET RECORDER

TECHNICAL FIELD

The present invention relates to methods of and apparatuses for wiping a line head in an ink jet recorder wherein the line head comprises a plurality of nozzle heads whose respective end faces for printing are each in the form of a long narrow rectangular plate and with a plurality of ink discharge nozzles and which are disposed side by side in a line and are jointly inclined relative to a direction in which they lie side by side in the line head.

BACKGROUND ART

An ink jet recorder using a line head tends to bring about the clogging of ink discharge nozzles with deteriorated ink and to incur the deterioration of printing quality due to entry of dust into ink discharge nozzles. Then, the need arises to wipe the nozzle faces of the line head. A conventional method of wiping a line head in an ink jet recorder in which the line head comprises a plurality of such nozzle heads disposed side by side is known as described e.g., in JP 2000-198210 A.

An apparatus for use in this conventional wiping method is so designed as shown in FIG. 1 in which a wiper belt b is so positioned as to be opposed to the print faces of a plurality of nozzle heads a, a, . . . and able to travel in a direction in which the nozzle heads are arranged side by side. A wiper blade c is so positioned as to be inclined relative to the direction in that direction of travel and able to wipe the nozzle heads of the nozzle blades a, a, . . . therewith transversely as the wiper belt b is driven to travel.

In the conventional wiping method described above in which as the wiper belt b travels the nozzle heads are wiped with the wiper blade c inclined relative to the direction in which they are disposed side by side, so that the wiper blade c so inclined comes to act on the gaps d, d, . . . , too, which are formed between the adjacent nozzle heads a, a, . . . As a result, while wiping, the wiper blade c passing obliquely over the gaps d cannot clean ink clogged in these gaps d but rather acts to drive into the gaps d such portions of ink as wiped off the nozzle faces.

And, where a line head is wiped having a plurality of long narrow rectangular plate like nozzle heads disposed side by side in a line and having narrow gaps between adjacent such nozzle heads, if a plenty of ink stays and accumulates in each such gap in the line head being wiped, such ink may flow off the gap and drop on a material being recorded, giving rise to a printing trouble thereon.

Further, the wiper blade is designed to wipe the nozzle faces of a line head by moving while being elastically deformed to conform to them with the result that contaminants such as portions of ink wiped off the nozzle faces of the line head tend to adhere to the end of the wiper blade. Since if these contaminants are left as they are, such contaminants tend again to adhere to the nozzle faces of the line head at the next time of wiping, they need be removed periodically.

Attempts have so far been made to remove such contaminants from a wiper blade in a wiping apparatus as described, e.g., in JP 2001-105612 A, by engaging the end of the wiper blade with a contaminant removal member while moving them relative to each other to scrape the contaminants from the wiper blade.

However, scraping adopted in the prior art to remove contaminants from the wiper blade merely transfers contaminants to the contaminant removal member and causes them to adhere to the latter. Consequently, the removal member is left with contaminants constantly coming to adhere thereto, giving rise to the problem that contaminants when detached from the scraper member by vibrations or the like scatter into the surroundings and contaminate the environment.

DISCLOSURE OF THE INVENTION

Accordingly, it is a first object of the present invention to provide a method of and an apparatus for wiping a line head in an ink jet recorder wherein the line head has a plurality of nozzle heads disposed side by side in a line, which is capable of wiping ink in gaps between adjacent nozzle heads as well and which is also capable of reducing or minimizing a residual amount of ink in gaps between adjacent nozzle heads in the line head after they have been wiped.

In order to achieve the first object mentioned above there is provided in accordance with the present invention in a first aspect thereof a line head wiping method for an ink jet recorder by wiping nozzle faces of a line head that comprises a plurality of nozzle heads each of which is in the form of a long narrow rectangular plate and which are disposed side by side in a line and inclined together relative to a direction perpendicular to a direction in which they lie side by side, which method comprises the steps of: bringing an elastically deformable blade into pressure contact with the nozzle faces of the line head; and moving the blade in a direction approximately parallel to the direction in which the nozzle heads are inclined while maintaining the blade under pressure to cause it to be deformed against the nozzle faces as it is moved.

In the method mentioned above, the blade may be oriented to extend perpendicular to the direction in which the nozzle heads are inclined and is moved. Alternatively, the blade may be oriented to extend in a direction that is inclined relative to the direction in which the nozzle heads lie side by side at an angle of inclination that is smaller than an angle of inclination at which the nozzle heads are inclined relative to the direction perpendicular to the direction in which they lie side by side whereby the blade is moved, being oriented to extend in the direction that is inclined relative to the direction perpendicular to the direction in which the nozzle heads are inclined.

According to the method mentioned above that can be practiced with a line head wiping apparatus in which a blade that is held inclined is moved in a direction approximately parallel to a direction in which a plurality of nozzle heads are inclined, it becomes possible to wipe not only ink on the nozzle faces of these nozzle heads but also ink that has come into gaps between the adjacent nozzle heads.

The present invention also provides a line head wiping method for an ink jet recorder by wiping nozzle faces of a line head that comprises a plurality of nozzle heads each of which is in the form of a long narrow rectangular plate and which are disposed side by side in a line and inclined together relative to a direction perpendicular to a direction in which they lie side by side, which method comprises the steps of: bringing an elastically deformable blade into pressure contact with the nozzle faces of the line head; orienting the blade to extend in a direction approximately parallel to the direction in which the nozzle heads are inclined; and moving the blade in a direction in which the nozzle heads lie side by side.

According to the abovementioned method in which the blade is oriented to extend in a direction approximately parallel to the direction in which the nozzle heads of the line head are inclined and the blade is moved in the direction in which the they lie side by side, it becomes possible for the end of the blade moving over nozzle faces of the line head to come into a gap between one nozzle head and a next each time it has wiped the one nozzle face of the nozzle head and thereby to wipe off not only ink adherent on the adjacent nozzle faces but also ink trapped in the gaps between them.

The present invention further provides a line head wiping method for an ink jet recorder by wiping nozzle faces of a line head that comprises a plurality of nozzle heads each of which is in the form of a long narrow rectangular plate and which are disposed side by side in a line and inclined together relative to a direction perpendicular to a direction in which they lie side by side, which method comprises the steps of: bringing an elastically deformable blade into pressure contact with the nozzle faces of the line head; orienting the blade to extend in a direction that is inclined relative to the direction perpendicular to the direction in which the nozzle heads lie side by side; and moving the blade in the direction in which the nozzle heads lie side by side while maintaining the blade under pressure to cause it to be deformed against the nozzle faces as it is moved, wherein an angle of inclination at which the blade is inclined relative to the direction perpendicular to the direction in which the nozzle heads lie side by side is smaller than an angle of inclination at which the nozzle heads are inclined relative to the direction perpendicular to the direction in which they lie side by side whereby the blade is moved, being oriented to extend in a direction inclined relative to the direction in which the nozzle heads are inclined.

According to the abovementioned method, it becomes possible to better wipe the nozzle faces of the nozzle heads as well as the gaps between them.

As a result, these methods make it possible to reduce the amount of ink that may remain over the nozzle heads of a line head which have been wiped with the blade and thereby to better record on a recording medium without causing any printing trouble such as ink drops.

The present invention also provides a line head wiping apparatus for an ink jet recorder for wiping nozzle faces of a line head that includes a plurality of nozzle heads each of which is in the form of a long narrow rectangular plate and which are disposed side by side in a line and inclined together relative to a direction in which they lie side by side, which apparatus comprises: a base plate; a rotating table rotatably mounted on the base plate and adapted to be fixed relative thereto; a saddle table mounted on the rotating table and having a horizontal guide rail; a slide mounted on the saddle table and adapted to be moved thereon by being guided on the guide rail; a blade table mounted on the slide and adapted to be swung in a horizontal plane about an axis at an end of the slide in a direction orthogonal to that in which the slide can be slid; and a blade mounted on the blade table so as to be movable vertically and adapted to wipe the nozzle faces of the line head. This apparatus may further comprise a means for adjusting the blade table at least as to its vertical position.

According to the abovementioned apparatus, it becomes possible not only to choose as desired a direction of wiping with a blade for wiping the nozzle faces of a line head in an ink jet recorder but also to adjust as desired an orientation of the blade relative to the blade wiping direction. Thus, the nozzle faces of a line lead that comprises a plurality of long narrow rectangular plate like nozzle heads disposed side by side in a line and inclined relative to the direction in which they are so disposed can be wiped with a blade selectively either in a direction in which the nozzle heads lie side by side or in a direction in which they are inclined. Moreover, it becomes possible to alter the orientation of a blade relative to its wiping direction to meet with a state of ink adhering on the nozzle faces of a line head.

A second object of the present invention is to provide a line head wiping apparatus for an ink jet recorder whereby contaminants as they are transferred onto the blade by its wiping action can completely be removed from the blade without leaving their residues thereon, namely by avoiding the use of any contaminant removal member as in the prior art that may otherwise cause their scattering into the surroundings.

This object is achieved in accordance with the present invention in another aspect thereof by a line head wiping apparatus for an ink jet recorder having a line head comprising a plurality of nozzle heads disposed in a line for wiping nozzle faces of the line head by moving a blade in contact with the nozzle faces, which apparatus comprises: a means whereby the blade is movable between a wiping position at which it is brought into contact with the nozzle faces of the line head and a standby position at which it is held away from the line head; and a spray nozzle means disposed opposite to an end of the blade at the standby position for spraying a cleaning liquid onto the same.

According to this apparatus, contaminants as they are transferred onto the blade by its wiping action can be removed directly by cleaning liquid applied thereto from the spray nozzle means and without resort to a prior contaminant removal member, hence without contaminants scattering and contaminating the environment as is to be the case when such a member is used.

The apparatus mentioned above may further comprise a rotatable wiper roll adapted to be brought into contact with, and away from, a wiping surface of the blade at the standby position.

According to the abovementioned apparatus, there is added to the washing action by the spray nozzle means the action by the wiper roll to wipe the wiping surface of the blade. Since this makes it possible to leave the washed blade clean, the components are rendered better maintainable and the product kept better in quality.

BRIEF DESCRIPTION OF THE DRAWINGS

These and other objects, features and advantages of the present invention as well as other manners of its implementation will become more readily apparent, and the invention itself will also be better understood, from the following detailed description with reference to the drawings attached hereto showing certain illustrative forms of implementation of the present invention. In the drawings.

BEST MODES FOR CARRYING OUT THE INVENTION

Hereinafter, the present invention will be described in detail with reference to the accompanying drawings, beginning with a first form of implementation thereof.

Figure 1:
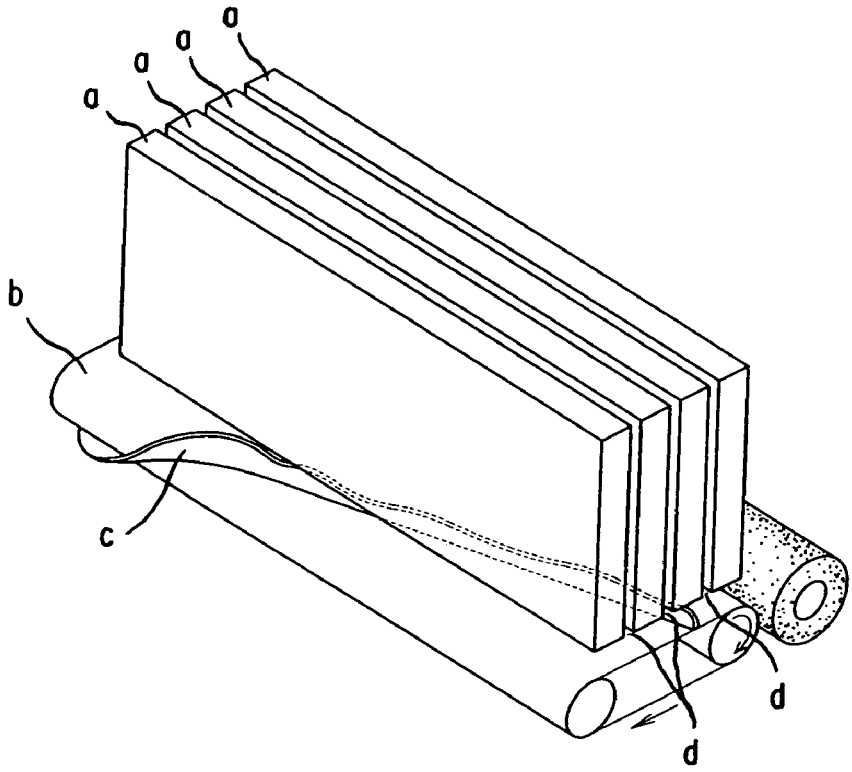
PRIOR ART FIG. 1
FIG. 1 is a perspective view illustrating the prior art.
Figure 2:
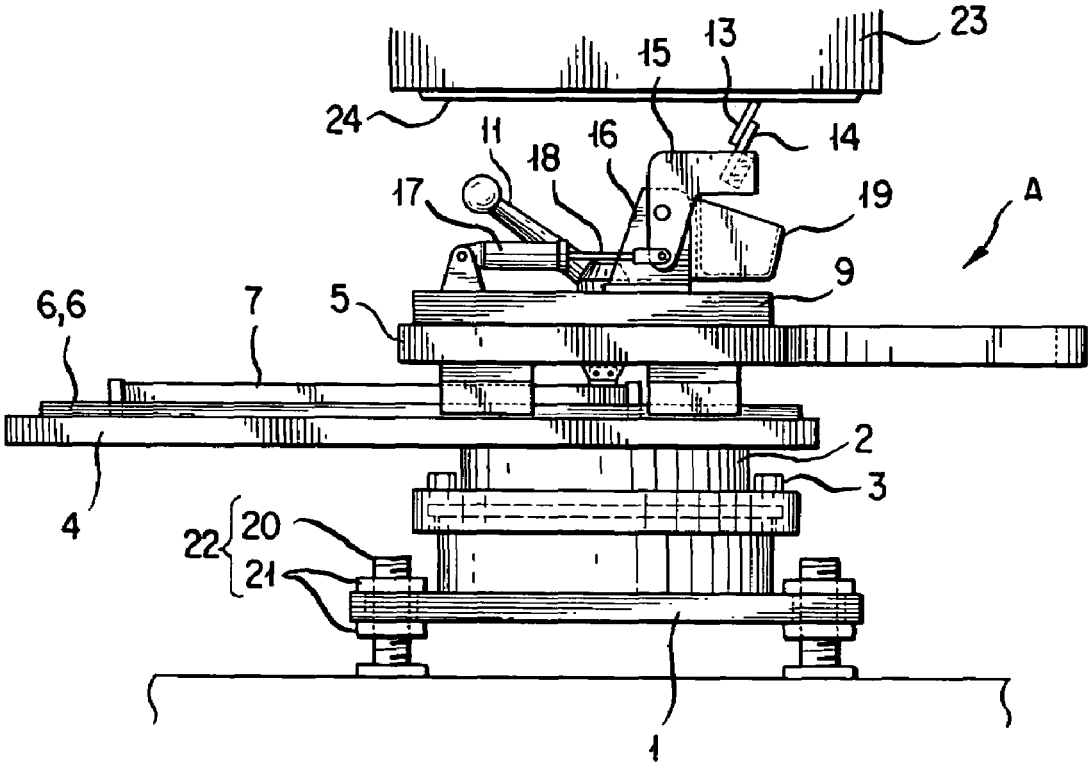
FIG. 2 is a front view illustrating a wiping apparatus for carrying out a method of the present invention.
Figure 3:
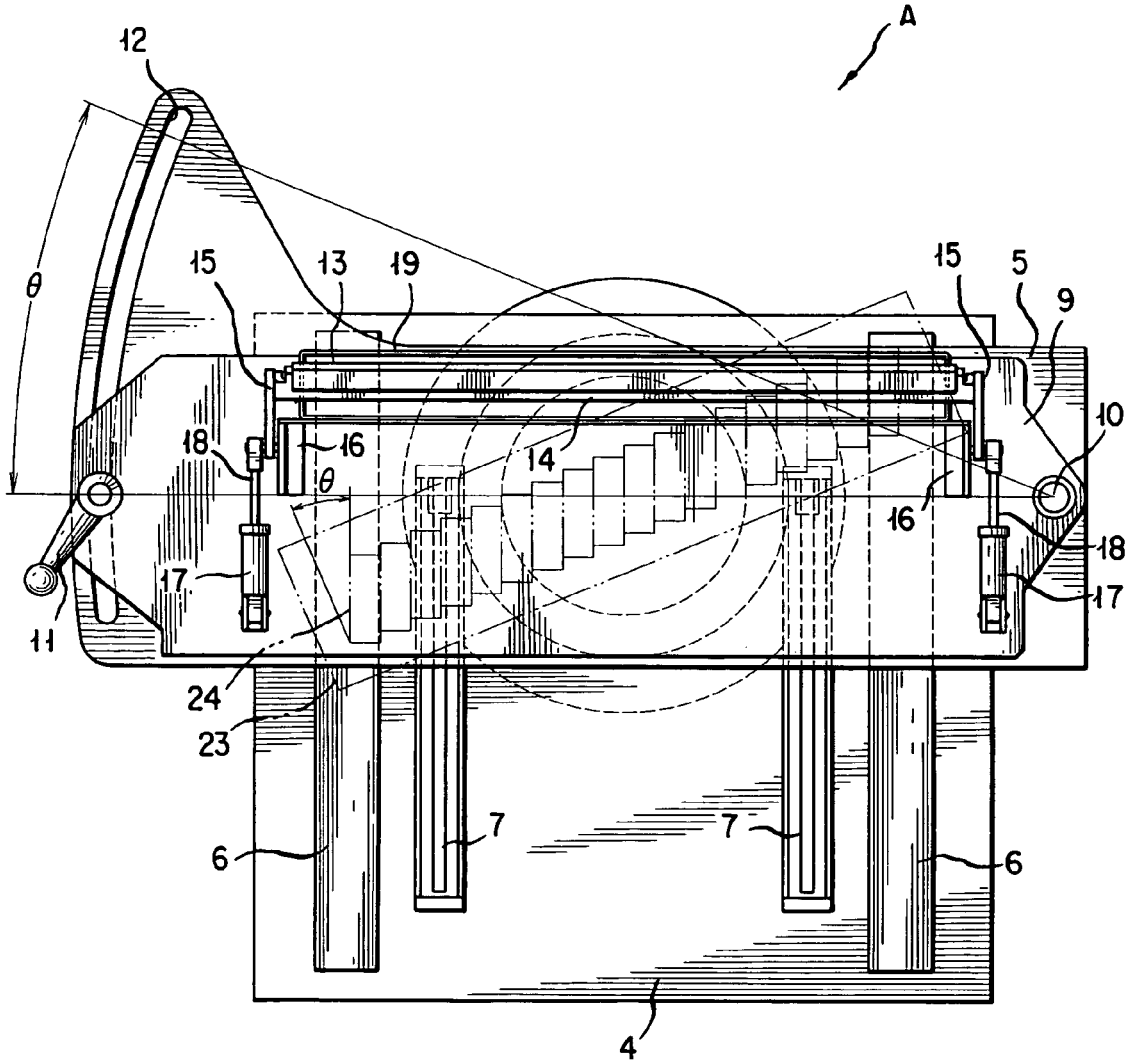
FIG. 3 is a top plan view illustrating the wiping apparatus shown in FIG. 2.

FIGS. 2 and 3 are a side and a top plan view, respectively, diagrammatically illustrating a line head wiping apparatus A for carrying out a method of the present invention. In the Figures there are shown a base plate 1 and a rotating table 2 that is mounted on the base plate 1 rotatably about a vertical axis relative thereto. The rotating table 2 can be fixed to the base plate 1 by bolts 3 at a rotary position as desired relative thereto.

In the Figures there is also shown a saddle table 4 mounted horizontally on the rotating table 2 as well as a slide 5 mounted on the saddle table 4 in such a manner that the slide can reciprocate or move forth and back horizontally while being guided by a pair of rails 6 and 6 laid on the saddle table 4. The slide 5 is moved forth and back by a rodless cylinder 7 to which it is coupled.

As shown in the Figures, a blade table 9 is mounted on an upper surface of the slide 5 and supported by a support shaft 10 at an end of the slide 5 in a direction orthogonal to that in which the slide is slid so that the blade table 9 can be swung about the shaft 10 in a horizontal plane. The blade table 9 is provided at its other end with a fixing handle 11 which is fitted there in a circular groove 12 formed so as to center on the support shaft 10. The blade table 9 can thus be fastened by the fixing handle 11 to take any angular (swing) position as desired within a range of swinging angles defined by the circular groove 12.

As shown, a wiper blade 13 that is flexible or elastically deformable as composed of rubber or the like is in the form of a plate or sheet of a given length having a reinforcement sheet or plate 14 fastened to its breadthwise one end. The reinforcement sheet 14 in turn has a pair of rotary members 15 and 15 whose respective first ends are fastened to its opposite ends, respectively, and which are rotatably supported at their intermediate regions, respectively, from a pair of brackets 16 and 16 mounted on the blade table 9. The rotary members 15 and 15 also have their respective second ends coupled to piston rods 18 and 18 of a pair of cylinder units 17 and 17 mounted on the blade table 9 so that a telescopic motion of the cylinder units 17 and 17 causes the rotary members 15 and 15 to rotate and in turn the end of the blade 13 circularly to move vertically. An ink catcher or reservoir 19 is provided underneath the blade 13.

The base plate 1 is mounted on the floor by means of a jack unit 22 that comprises screw shafts 20 and nut members 21 screwed thereon. The nut members 21 in the jack unit 22 can be turned to vertically move the apparatus as a whole, adjusting the vertical position of the blade 13. Alternatively, rather than at the location to vertically move the base plate 1, the jack unit 22 may be positioned at the location to vertically move the slide 5 relative to the rotating table 2. In short, the jack unit 22 may be positioned at any location if it can vertically move the blade table 9 that supports the blade 13, and its makeup need not be limited to that mentioned above, either.

The line head wiping apparatus A constructed as mentioned above is positioned laterally of an ink jet recorder. This ink jet recorder has a line head 23 positioned as shown in FIG. 3 when it is moved in a direction perpendicular to its printing direction (main scanning direction) from its printing position to a maintenance position, where its lower surface lies above the line head wiping apparatus A.

Figure 4:
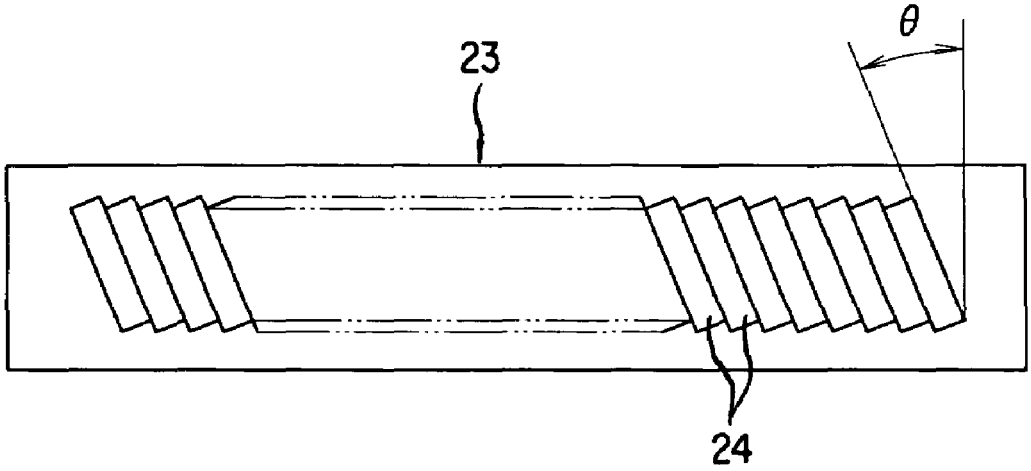
FIG. 4 is a bottom plan view illustrating a line head in an ink jet recorder to which a method of the present invention is to be applied.

The line head 23 as it is viewed from below is shown in FIG. 4 where it is seen that there are arranged side by side a plurality of long narrow rectangular plate like nozzle heads 24 oriented with an angle θ of inclination relative to a direction perpendicular to that in which they lie side by side in the line head 23. Each of the nozzle heads 24 is formed in its printing side end face with a plurality of ink discharge nozzles (not shown) aligned lengthwise.

Mention is now made of a first wiping method of the invention using the line head wiping apparatus A constructed as mentioned above.

As shown in FIG. 3, the line head 23 of the ink jet recorder is moved to lie above the line head wiping apparatus A brought to its maintenance position. With the apparatus A in this position, the rotating table 2 is rotated until the blade 13 becomes orthogonal in orientation to the direction of inclination of the nozzle heads 24 in the line head 23, and is then fixed. Thereafter, the reciprocating rodless cylinder 7 is operated to move the slide 5 to a standby position and thereby to move and then leave the blade 13 away from the line head 23.

Subsequently, the cylinder units 17 and 17 for rotation are extendedly operated to rotate the blade 13 to its raised position and to raise its end circularly. Then, it will be checked if the end of the blade 13 has reached a height at which it can interfere with the nozzle heads 24 of the line head 23. The blade 13 is then adjusted in its height by the jack unit 22.

In this state the reciprocating rodless cylinder 7 is again operated to move the slide 5 slidably on the rails 6 and 6, thereby causing the blade 13 to move into pressure contact with nozzle faces of the nozzle heads 24 in the line head 23 while permitting its end portion contacting the nozzle faces to deform elastically whereby these nozzle faces of the nozzle heads 24 are wiped by the blade 13.

Figure 5:
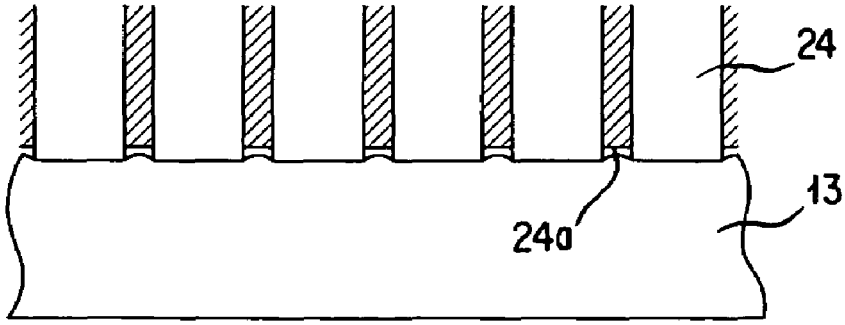
FIG. 5 is an explanatory view illustrating how a blade is designed to act in a first wiping method of the present invention.

Then, elastic deformation of the blade 13 urged against the nozzle heads 24 while moving in the direction of their inclination causes end portions of the blade 13 as shown in FIG. 5 to project somewhat into gaps 24 between the nozzle heads 24 and to move along these gaps. As a result, ink not only on surfaces of the nozzle heads 24 but also in the gaps 24*a* between the adjacent nozzle heads 24 can be wiped.

Figure 6:
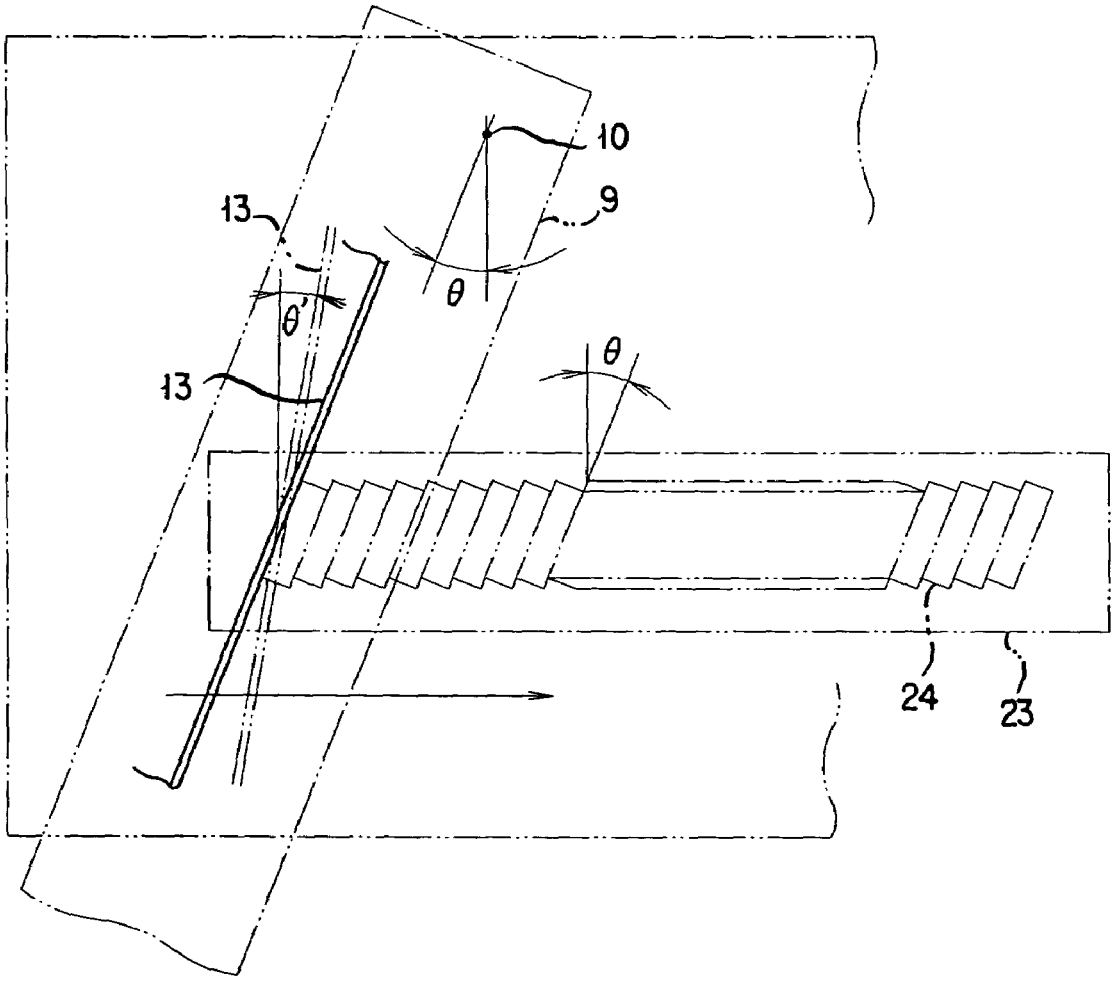
FIG. 6 is an operational explanatory view illustrating a second wiping method of the present invention.

Mention is next made of a second wiping method of the invention. This method as shown schematically in FIG. 6 is to orient the blade 13 parallel to long sides of the nozzle heads 24 in conformity with their inclination and then to move the blade 13 in the direction in which the nozzle heads 24 in a line head 23 are arranged side by side (in the direction indicated by the arrow).

This causes the blade 13 each time it passes the nozzle face of each individual nozzle head 24 to have its end portion enter the gap between the nozzle head 24 and a next nozzle head 24, thereby acting to scrape ink out of the gap.

The gaps are thus successively wiped of ink.

In the line head wiping apparatus A in this case the rotating table 2 is rotated to align the direction in which the slide 5 is moved with the direction in which the nozzle heads 24 lie side by side. Thereafter, the blade table 9 is rotated about the support shaft 10 by an angle corresponding to an angle θ of inclination of the nozzle heads 24, thereby orienting the blade 13 to extend in a direction parallel to the long sides of the nozzle heads 24. The slide 5 is then moved by operating the rodless cylinder 7. Further, it may be noted that when designed to perform this wiping method that requires the slide 5 to move a distance sufficient to cover an overall length of the line head 23, the nozzle head wiping apparatus A requires that the slide 5 have a stroke greater than when designed to perform the first wiping method.

In both the first and second methods of the invention, depending on various conditions such as states of ink adhering on the nozzle faces of the nozzle heads 24, it is possible to alter the angular orientation of the blade 13 as desired relative to the direction in which to move the blade table 9 by changing the angular position of the blade table 9 relative to the slide 5. Likewise, changing the rotary position of the rotating table 2 allows the direction in which the blade 13 is moved to be altered as desired relative to the nozzle heads 24 of the line head 23.

Figure 7:
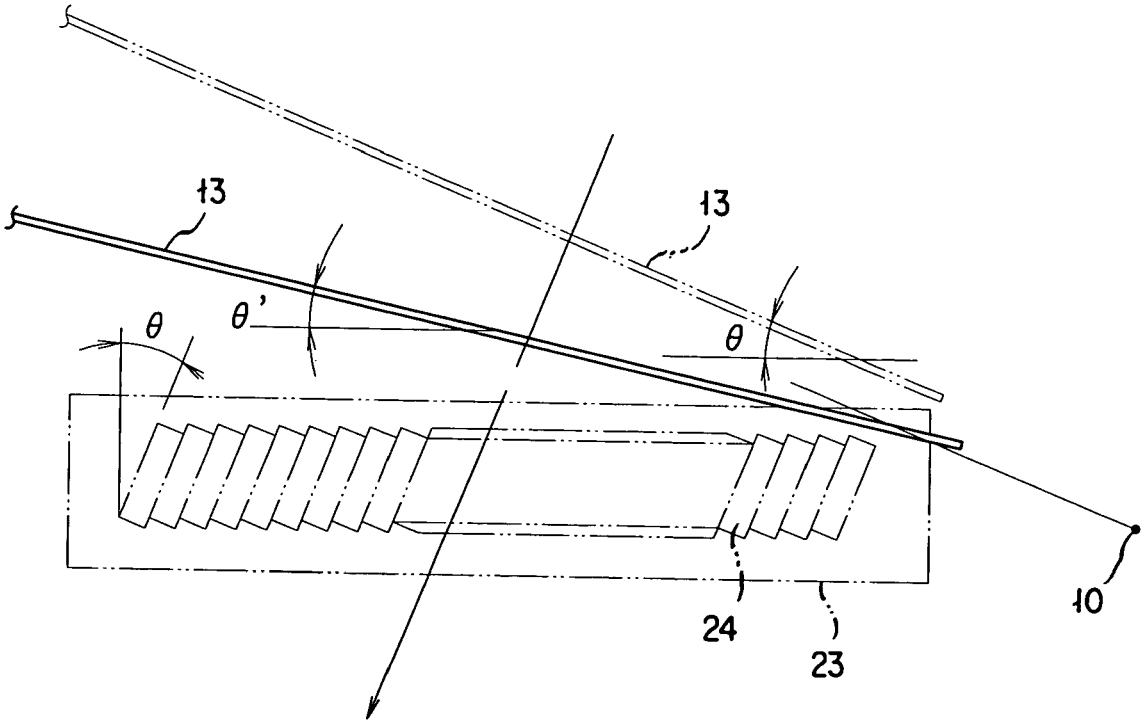
FIG. 7 is an operational explanatory view illustrating a modification of the first wiping method of the present invention.

FIG. 7 shows a modification of the first wiping method performed in a state as shown in FIG. 3 wherein the blade table 9 is rotated relative to the slide 5 moving in the direction of inclination of the nozzle heads 24 so that the blade 13 relative to the direction in which the nozzle heads 24 are arranged side by side is inclined at an angle θ' that is different from the angle θ in the first wiping method. In this case, the blade 13 taking an angular orientation inclined at the angle θ' to the direction in which the nozzle heads 24 lie side by side, namely making somewhat angle with the direction orthogonal to the direction of their inclination is moved in the direction of inclination of the nozzle heads 24 to perform wiping when the slide 5 is moved. Here, the angle θ' is smaller than θ, the angle of inclination of the nozzle heads 24.

Also, in the second wiping method shown in FIG. 6, as indicated there by the chain line it is possible for the blade 13 to take a posture inclined at an angle θ' smaller than θ, the angle of inclination of the nozzle heads 24, relative to the direction orthogonal to the direction in which the nozzle heads 24 are arranged side by side and then to be moved in the side by side direction. Here, too, ink within the nozzle gaps as well as on the nozzle faces can favorably be wiped.

Figure 8:
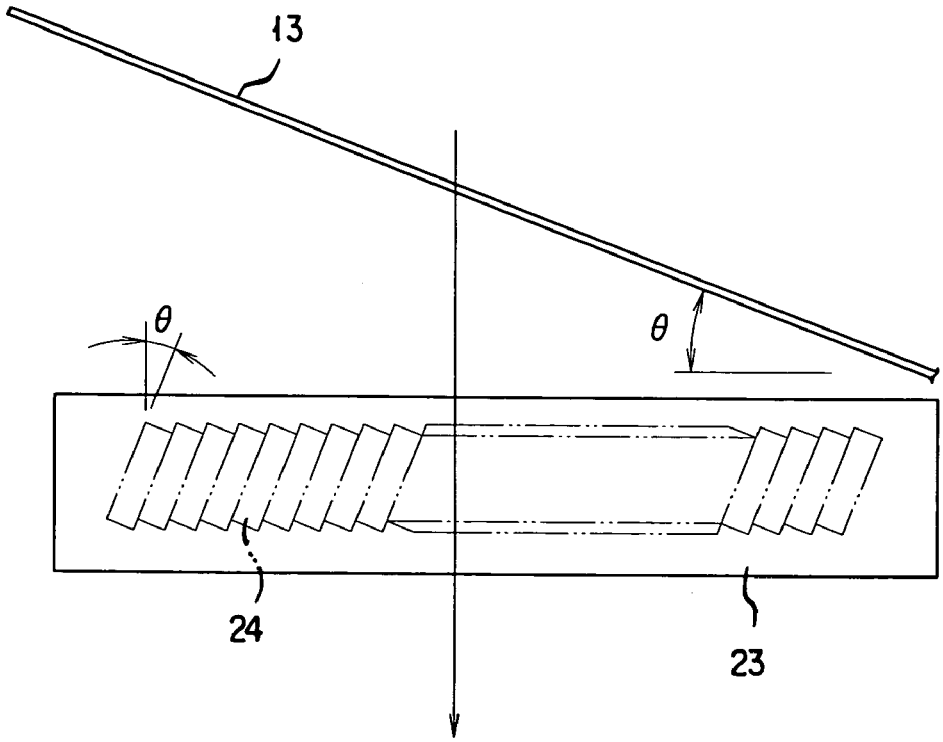
FIG. 8 is an operational explanatory view illustrating another modification of the first wiping method of the present invention.

FIG. 8 shows an arrangement in which the rotating table 5 is set so that the slide 5 can be moved in a direction orthogonal to the side by side direction of the nozzle heads 24 of the line head 23 and the blade table 9 is set so that the blade 13 is oriented inclined at an angle θ relative to the side by side direction of the nozzle heads 24 of the line head 23 to perform wiping. In this case, the blade 13 is allowed to perform wiping while describing a trajectory inclined at the angle θ relative to the direction of inclination of the nozzle heads 24.

The nozzle face (printing side end face) of each of nozzle heads 24 in a line head 23 as mentioned above is formed with a large number of ink discharge nozzles in a row. Usually, such a row of ink discharge nozzles is formed parallel to the long side of the rectangular nozzle face of each long narrow rectangular plate like nozzle head 24. In this case, the nozzle face of the nozzle head 24 can be wiped along the nozzle row, e.g., according to the first wiping method of the invention described above.

Figure 9:
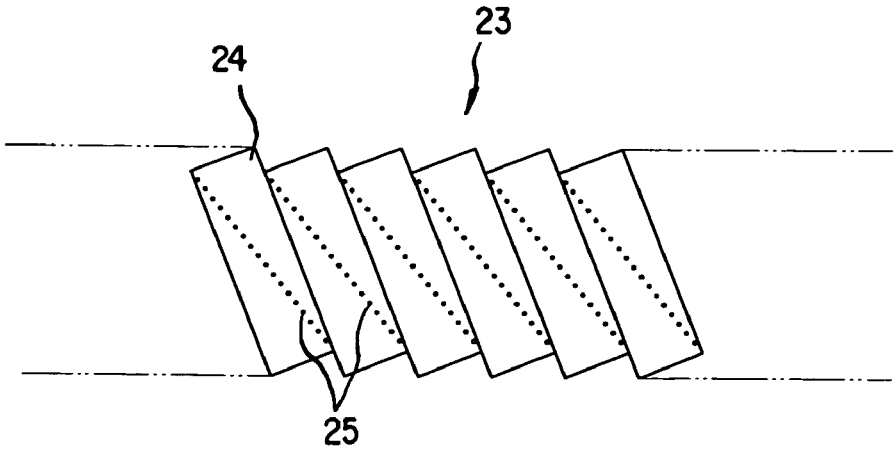
FIG. 9 is an explanatory view illustrating an exemplary arrangement of ink discharge nozzles in a nozzle head.

If the row of ink discharge nozzles is however formed inclined relative to the long side of the nozzle head 24 as shown at 25 in FIG. 9, it is likely that residual ink left adhering on the nozzle face of the nozzle head 24 may be brought about along the nozzle now 25.

In this case, for wiping the nozzle face of such a nozzle head 24 it is possible to perform wiping by moving the blade 13 in a direction in which the nozzle row 25 lies.

In the first form of implementation of the invention described above, it should be understood that means for moving the slide 5 forth and back is not limited to the rodless cylinder shown and described but may alternatively be any other suitable drive means such as a fluid operated cylinder or a rack and pinion mechanism or the like.

Mention is next made of a second form of implementation of the present invention.

Figure 10:
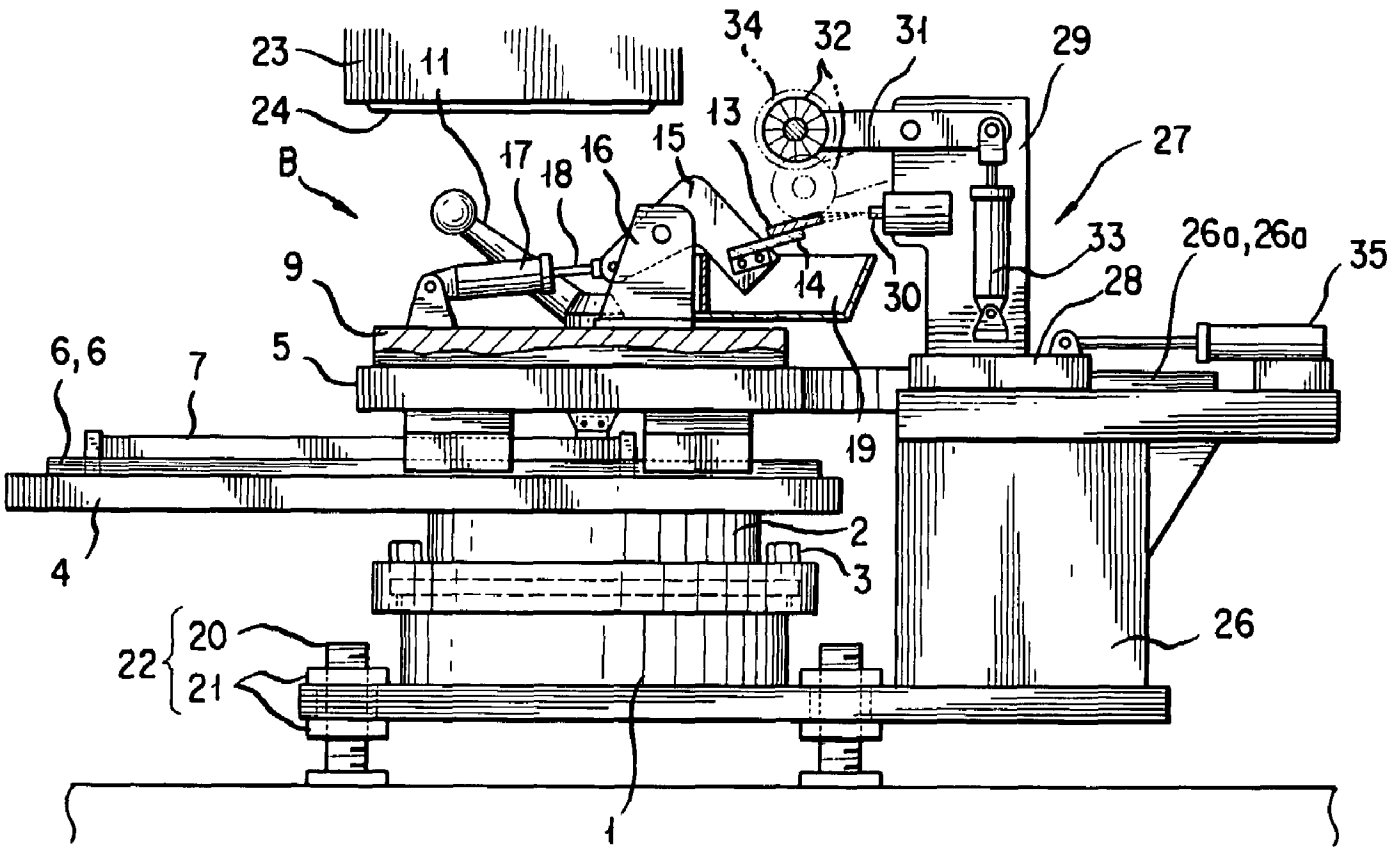
FIG. 10 is a front view, in part broken, illustrating another embodiment of the wiping apparatus according to the present invention
Figure 11:
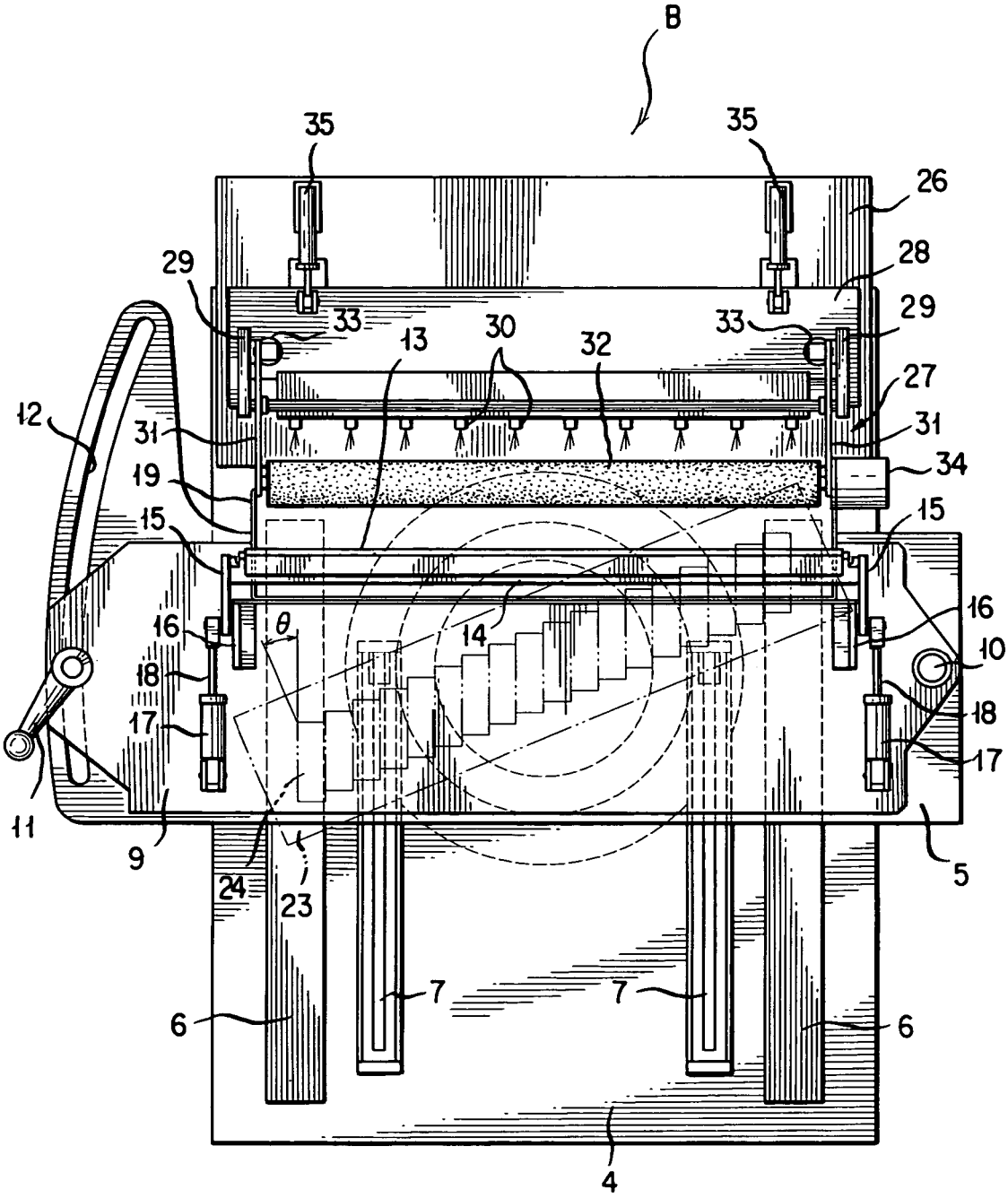
FIG. 11 is a plan view of the wiping apparatus shown in FIG. 10.

FIGS. 10 and 11 are a front and a plan view, respectively, diagrammatically illustrating a line head wiping apparatus B in accordance with the present invention. The line head wiping apparatus B is identical in construction to the line head wiping apparatus A shown and described above except for an additional, blade cleaning means and the description of identical parts of the construction will be omitted here.

A stand 26 is mounted on the base plate 1 laterally so as not to interfere with the operation of the rotating table 2. The stand 26 has a blade cleaning unit 27 mounted thereon as being movable in a direction perpendicular to the center of rotation of the rotating table 2.

The blade cleaning unit 27 comprises a slide 28 guided by a pair of rails **26*a* and 26*a* and thereby slidably supported on the stand 26; a plurality of spray nozzles 30 mounted between a pair of brackets 29 and 29 standing on the slide 28 to face a blade 13; a wiper roll 32 made of nonwoven fabric and rotatably supported between the ends of a pair of arms 31 and 31 rotatably supported by the brackets 29 and 29; a pair of cylinder units 33 and 33 for rotating the arms 31 and 31 supporting the wiper roll 32; a motor 34 for rotating the wiper roll 32; and a cylinder unit 35 for moving the slide 28 relative to the stand 26**.

The spray nozzles 30 extend across a length and the wiper roll 32 has a length, which are somewhat longer than the blade 13, and the spray nozzles 30 are adapted to spray cleaning fluid towards the blade 13.

The wiper roll 32 is moved into contact with/away from the wiping surface of the blade 13 in a standby position when the arms 31 and 31 supporting the wiper roll is rotated by the cylinder units 33 and 33. When in contact with the wiping surface of the blade 13 flushed with cleaning fluid, the wiper roll 32 is designed to rotate with the motor 34 driven, acting to wipe its adherent cleaning liquid from the wiping surface and make it clean.

The line head wiping apparatus B constructed as mentioned above is operated as described below.

As shown in FIGS. 10 and 11, the line head 23 of an ink jet recorder is moved to lie above the line head wiping apparatus B brought to its maintenance position. With the apparatus B in this position, the rotating table 2 is rotated until the blade 13 becomes orthogonal in orientation to the direction of inclination of the nozzle heads 24 in the line head 23, and is then fixed. Thereafter, the sliding rodless cylinder 7 is operated to move the slide 5 to a standby position and thereby to move and then leave the blade 13 away from the line head 23.

Subsequently, the cylinder units 17 and 17 for rotation are extendedly operated to rotate the blade 13 to its raised position and to raise its end circularly, thereby having it take the wiping position. Then, it will be checked if the end of the blade 13 has reached a height at which it can interfere with the nozzle heads 24 of the line head 23. The blade 13 is then adjusted in its height by the jack unit 22.

In this state the reciprocating rodless cylinder 7 is again operated to move the slide 5 slidably on the rails 6 and 6 from a standby position, thereby causing the blade 13 to move into pressure contact with lower faces of the nozzle heads 24 in the line head 23 while permitting its end portion contacting the nozzle faces to deform elastically whereby these lower faces of the nozzle heads 24 are wiped by the blade 13.

Then, elastic deformation of the blade 13 urged against the nozzle heads 24 while moving in the direction of their inclination causes end portions of the blade 13 as shown in FIG. 5 to project somewhat into gaps 24 between the nozzle heads 24 and to move along these gaps. As a result, ink not only on surfaces of the nozzle heads 24 but also in the gaps 24*a* between the adjacent nozzle heads 24 can be wiped.

Upon completion of the above wiping operation, the cylinder unit 17 is contractively operated to rotate the blade 13 in its turn-down direction such as to lower its end circularly, thereby having it take a standby position. Then, the rodless cylinder 7 is operated in the reverse direction to move the slide 5 to a standby position at which the blade 13 lies away from the line head 23.

The blade 13 at this standby position takes its standby position whereby it is inclined towards the blade cleaning unit 27 as shown in FIG. 10. Then, the cylinder unit 35 is extendedly operated to move the blade cleaning unit 27 towards the blade 13. This causes the spray nozzles 30 to be opposite to the end of the blade 13. Then, the cylinder unit 33 has been extendedly operated to have the wiper roll 32 raised.

In this stage, the nozzles 30 are operated to spray cleaning liquid. This causes contaminants such as residual ink adherent on the wiping surface of the blade 13 to be removed from the latter with the cleaning liquid and the cleaning liquid with the contaminants entrained therein to be collected in the ink reservoir 19. Here, an air regulator is used to properly adjust the air pressure under which the cleaning liquid is sprayed from the spray nozzles 30.

Subsequently, with the spray nozzles 30 that terminates and ceases spraying the cleaning liquid, the wiper roll 32 is moved down to come into contact with the wiping surface of the blade 13 and then rotated with the motor 34 driven. This causes the cleaning liquid adherent on the wiping surface of the blade 13 to be wiped off with the wiper roll 32.

A series of actions as mentioned above can be performed automatically by controlling via a controller the cylinder units operating the active members mentioned above.

Further, while the blade 13 may be cleaned simply by means of spray nozzles, wiping off ink and cleaning liquid subsequently with the wiper roll 32 gives a better wiping. Moreover, flushing with cleaning liquid by the spray means 30 and wiping off with the wiper roll 32 can be repeated to give a better cleaning.

What is claimed is:

1. A line head wiping method for an ink jet recorder by wiping nozzle faces of a line head that comprises a plurality of nozzle heads each of which is in the form of a long narrow rectangular plate and which are disposed side by side in a line and inclined together relative to a direction perpendicular to a direction in which they lie side by side, which method comprises the steps of:

bringing an elastically deformable blade into pressure contact with the nozzle faces of the line head; and moving the blade in a direction approximately parallel to the direction in which the nozzle heads are inclined while maintaining the blade under pressure to cause it to be deformed against said nozzle faces as it is moved.

2. A line head wiping method for an ink jet recorder as set forth in claim 1 wherein the blade is oriented to extend perpendicular to the direction in which the nozzle heads are inclined and is moved.

3. A line head wiping method for an ink jet recorder as set forth in claim 1 wherein the blade is oriented to extend in a direction that is inclined relative to the direction in which the nozzle heads lie side by side at an angle of inclination that is smaller than an angle of inclination at which the nozzle heads are inclined relative to the direction perpendicular to the direction in which they lie side by side whereby the blade is moved, being oriented to extend in the direction that is inclined relative to the direction perpendicular to the direction in which the nozzle heads are inclined.

4. A line head wiping method for an ink jet recorder by wiping nozzle faces of a line head that comprises a plurality of nozzle heads each of which is in the form of a long narrow rectangular plate and which are disposed side by side in a line and inclined together relative to a direction perpendicular to a direction in which they lie side by side, which method comprises the steps of:

bringing an elastically deformable blade into pressure contact with the nozzle faces of the line head;

orienting the blade to extend in a direction approximately parallel to the direction in which the nozzle heads are inclined; and moving the blade in the direction in which the nozzle heads lie side by side.

5. A line head wiping method for an ink jet recorder by wiping nozzle faces of a line head that comprises a plurality of nozzle heads each of which is in the form of a long narrow rectangular plate and which are disposed side by side in a line and inclined together relative to a direction perpendicular to a direction in which they lie side by side, which method comprises the steps of:

bringing an elastically deformable blade into pressure contact with the nozzle faces of the line head;

orienting the blade to extend in a direction that is inclined relative to the direction perpendicular to the direction in which the nozzle heads lie side by side; and moving the blade in the direction in which the nozzle heads lie side by side while maintaining the blade under pressure to cause it to be deformed against said nozzle faces as it is moved, wherein an angle of inclination at which the blade is inclined relative to the direction perpendicular to the direction in which the nozzle heads lie side by side is smaller than an angle of inclination at which the nozzle heads are inclined relative to the direction perpendicular to the direction in which they lie side by side whereby the blade is moved, being oriented to extend in a direction inclined relative to the direction in which the nozzle heads are inclined.

6. A line head wiping apparatus for an ink jet recorder for wiping nozzle faces of a line head that includes a plurality of nozzle heads each of which is in the form of a long narrow rectangular plate and which are disposed side by side in a line and inclined together relative to a direction in which they lie side by side, which apparatus comprises:

a base plate;

a rotating table rotatably mounted on the base plate and adapted to be fixed relative thereto;

a saddle table mounted on the rotating table and having a horizontal guide rail; a slide mounted on the saddle table and adapted to be moved thereon by being guided on the guide rail;

a blade table mounted on the slide and adapted to be swung in a horizontal plane about an axis at an end of the slide in a direction orthogonal to that in which the slide can be slid; and a blade mounted on the blade table so as to be movable vertically and adapted to wipe the nozzle faces of the line head.

7. A line head wiping apparatus for an ink jet recorder as set forth in claim 6, further comprising a means for adjusting the blade table at least as to its vertical position.

8. A line head wiping apparatus for an ink jet recorder having a line head comprising a plurality of nozzle heads which are disposed side by side in a line and inclined together relative to a direction perpendicular to the direction in which said nozzle heads lie side by side, for wiping nozzle faces of the line head by moving a blade in contact with the nozzle faces, which apparatus comprises:

a means for altering a direction of movement of the blade for wiping the nozzle faces;

a means for altering an angular orientation of the blade relative to the direction of movement of the blade;

a means for moving the blade between a wiping position at which it is brought into contact with the nozzle faces of the line head and a standby position at which it is held away from the line head; and a spray nozzle means disposed opposite to an end of the blade at the standby position for spraying a cleaning liquid onto the same.

9. A line head wiping apparatus for an ink jet recorder as set forth in claim 8, further comprising a rotatable wiper roll adapted to be brought into contact with, and away from, a wiping surface of the blade at the standby position.

* * * * *

UNITED STATES PATENT AND TRADEMARK OFFICE

CERTIFICATE OF CORRECTION

PATENT NO. : 7,390,074 B2
APPLICATION NO. : 11/115720
DATED : June 24, 2008
INVENTOR(S) : Hiroyuki Matsuba It is certified that error appears in the above-identified patent and that said Letters Patent is hereby corrected as shown below:

Title page, item 73 should read as follows:

--[73] Matsushita ~~Natsushita~~ Electric Industrial Co, Ltd., Kadoma (JP); Miyakoshi Printing Machinery Co., Ltd. Narashino (JP)--

Signed and Sealed this

Eighteenth Day of August, 2009

David J. Kappos

David J. Kappos
*Director of the United States Patent and Trademark Office*